US005912695A

United States Patent [19]

Kenbeek

[11] Patent Number: 5,912,695

[45] Date of Patent: Jun. 15, 1999

[54] SYSTEM FOR PRINTING PAIRS OF ENVELOPES OR THE LIKE

[75] Inventor: Dennis L. Kenbeek, Glastonbury, Conn.

[73] Assignee: Pitney Bowes Inc., Stamford, Conn.

[21] Appl. No.: 08/989,672

[22] Filed: Dec. 12, 1997

[51] Int. Cl.[6] ..... B65H 5/00

[52] U.S. Cl. ..... 347/262; 347/264; 395/111

[58] Field of Search ..... 347/139, 164, 347/116, 262, 264; 395/111; 229/69

[56] References Cited

U.S. PATENT DOCUMENTS

| | | | |
|---|---|---|---|
| 4,397,542 | 8/1983 | Brodesser | 347/139 |
| 4,538,905 | 9/1985 | Griego et al. | 347/139 |
| 4,603,846 | 8/1986 | Miles | 271/2 |
| 4,807,805 | 2/1989 | Rutkowski | 229/69 |
| 5,069,434 | 12/1991 | Sellers | 271/2 |
| 5,154,410 | 10/1992 | Baader et al. | 271/188 |
| 5,257,040 | 10/1993 | Czernik et al. | 347/225 |
| 5,343,556 | 8/1994 | Silverberg | 395/111 |

*Primary Examiner*—N. Le
*Assistant Examiner*—Hai C. Pham
*Attorney, Agent, or Firm*—Alberta A. Vitale; Robert H. Whisker; Melvin J. Scolnick

[57] ABSTRACT

An envelope printing system including a laser printer or similar printer operating under control of a microcomputer to print pairs of envelopes. The envelopes are printed with a FIM mark in a manner consistent with the requirements of the U. S. Postal Service. The envelopes are fed, two at a time, from a cassette which includes an identification mark. The envelopes are positioned in the cassette with their upper edges adjacent to the center line of the feed path and the printer controller is programmed to respond to identification of a cassette feeding pairs of envelopes to form an image containing two sub-images to be printed on corresponding envelopes. One of the sub-images is inverted so that the orientation of the printed information on the envelope will be correct.

8 Claims, 3 Drawing Sheets

SYSTEM FOR PRINTING PAIRS OF ENVELOPES OR THE LIKE

BACKGROUND OF THE INVENTION

The subject invention relates to a system for addressing envelopes or similar items. More particularly, it relates to a system including a laser printer or the like operating under control of a micro-computer or the like to print envelopes with addresses: the addresses including information in bar code form and a special mark in accordance with regulations of the U.S. Postal Service to indicate that the mailpiece is suitable for automated processing, which mark is referred hereinafter as a FIM mark.

Commonly assigned U.S. Pat. No. 5,257,040; to: Czernik et al. also relates to the printing of pairs of envelopes. This patent discloses a system for printing pairs of envelopes. This patent discloses a system for printing pairs of envelopes where the envelope pairs are fed through a printer offset with respect to the center line of the feed path while the image field is shifted in the opposite direction to assure that the upper edges of both envelopes are within the field and the FIM mark may be printed on each envelope in accordance with the requirements of the U.S. Postal Service.

It is known, as is taught in U.S. Pat. No. 4,397,542; to: Brodesser, to print envelopes using a laser printer or the like. In developing the system of the subject invention, Applicants have realized that it is desirable to print envelopes in a "two-up" mode. That is, to print envelopes two at a time, short edge first. (In general, the paper path of a laser printer is too narrow and the spacing between drive rollers is too great to allow normal envelopes to be fed long edge first.) Such "two-up" printing is known for use with multilith printer and duplicators, which are used to print sequences of envelopes with identical information. Such "two-up" feeding of envelopes is taught in U.S. Pat. Nos. 4,603,846 and 4,625,641; to: Miles and Jagoz et al., respectively. Applicants have recognized that it is highly desirable to provide a system wherein a substantially conventional laser printer is driven by a micro-computer to address sequences of envelopes. However, as will be discussed more fully below, the printing geometry of such printers is such that pairs of standard number 10 size envelopes are not easily printed in accordance with the U.S. Postal Service requirements for machinable mail. Particularly, it is difficult in such a system to position the FIM mark, which is a particular mark printed on a mail piece in accordance with U.S. Postal Service regulations to indicate that that mail piece is machinable, in accordance with U.S. Postal Service regulations. These regulations require that the FIM mark be printed within approximately one millimeter of the upper edge of the envelope.

Another commonly assigned patent is U.S. Pat. No. 5,343,556; to: Silverberg, which relates to two-up printing of envelopes. This patent discloses a system for determining the sequences in which envelopes are to be printed and is not concerned with the printing of either bar code or FIM marks.

Thus, it is an object of the subject invention to provide a system wherein a substantially conventional laser printer or the like may be used to simultaneously print pairs of envelopes with address information; the address information including FIM marks in the accordance with U.S. Postal Service regulations.

BRIEF SUMMARY OF THE INVENTION

The above object is achieved and the disadvantages of the prior art are overcome in accordance with the subject invention by means of a printing system for printing two envelopes simultaneously. The system includes a printer of the type which prints successive scan lines on a substrate (i.e., envelopes or other types of printable items) as the substrate is transported through the printer. The system also includes a feeder, such as a cassette, for feeding pairs of items simultaneously along a feed path to the printer so that successive pairs of the envelopes form successive substrates for printing. The feeder includes an alignment guide for registering the inboard edges of the envelopes with the center line of the feed path. The printer further includes a controller for controlling the printer to successively print images on successive substrates, the images each comprising two fields, the fields being registered with the center line so that each field is aligned with a corresponding one on the envelopes. A sub-image contained in each of the fields is thus printed on the corresponding envelope.

Since typically in a printer, such as a laser print, the scan lines produced are not long enough to completely cover a pair of typical envelopes as they are fed through the printer, the sub-images in the two fields are inverted with respect to each other so that, when the envelopes are fed through the printer with the upper edges adjacent to center line of the feed path, a FIM mark can be printed adjacent to the upper edge as required by U.S. Postal Service regulations. Thus, the above object is achieved. Other objects and advantages of the subject invention will be readily apparent to those skilled in the art from consideration of the detailed descriptions set forth below and of the attached drawings.

DETAILED DESCRIPTION OF PREFERRED EMBODIMENTS OF THE SUBJECT INVENTION

Figure 1:
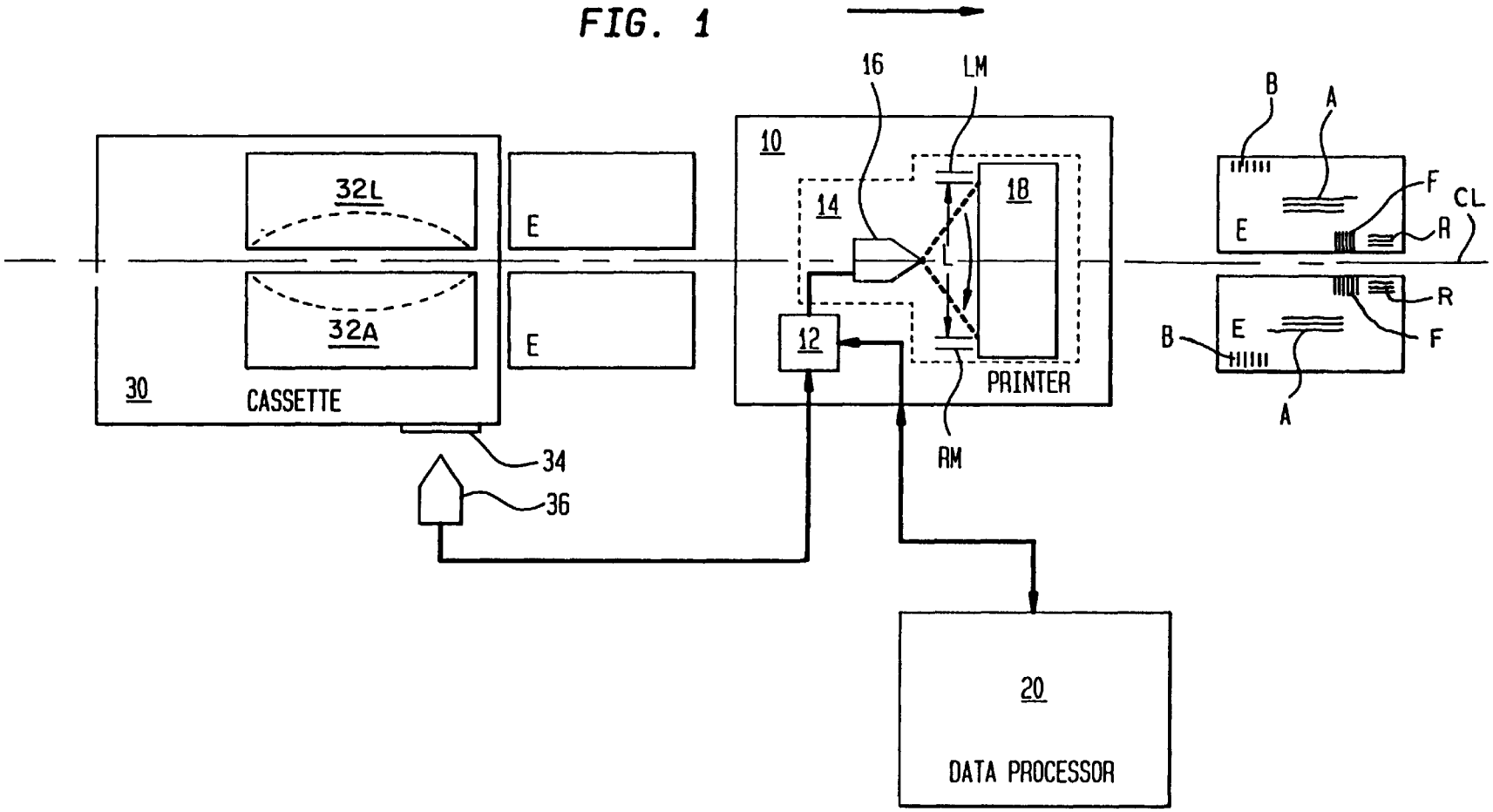
FIG. 1 shows a schematic block diagram of a system in accordance with the subject invention.

FIG. 1 shows a schematic block diagram of a system in accordance with the subject invention, which includes a printer 10. Printer 10 is preferably a substantially conventional laser printer with modifications as will be described further below, but may be any other suitable form of printer, such as a dot matrix printer, of the type which is used as an output printer for a microcomputer. A suitable printer would be a model W100 printer produced by the Mita Corporation of Japan and marketed by the assignee of the present application, modified as will be described below. Print engine 10 includes a controller 12, which is typically any suitable microprocessor, and a print engine 14. Print engine 14 includes a laser scanner 16 which operates under the control of controller 12 to scan print drum 18 with a raster of lines having a length to create a representation of an image on a substrate, which is shown in FIG. 1 to be a pair of envelopes transported side-by-side through printer 10. The scan lines comprising the image raster are positioned under control of controller 12 between a left margin LM and a right margin RM.

The operation of printers such as printer 10 is well understood by those skilled in the art and need to be discussed further here for an understanding of the subject invention.

Printer 10 operates under control of data processor 20, which may be any suitable computer and is typically a microcomputer, to print envelopes with address information in a conventional manner. Envelopes E, shown in FIG. 1, are printed by printer 10 with an image which includes address information A, a POSTNET™ barcode representative of the destination zip code B, a return address R, and FIM mark. The FIM mark is a special mark printed on an envelope in accordance with the regulations of the U.S. Postal Service to perform a coarse sort and to indicate that the envelope is suitable for handling by machine. In accordance with these regulations, the FIM mark must be printed within approximately 1 millimeter of the upper edge of the envelope. As will be described below, this requirement requires modification of printer 10 in accordance with the subject invention.

Pairs of envelopes E are input to printer 10 from a cassette 30 or other suitable feeder. Cassettes are generally known for use with laser printers, copiers and other forms of equipment which print on various substrates. Cassette 30 includes a pair of mechanisms 32L and 32R for holding stacks of envelopes and feeding successive pairs of envelopes into printer 10. Mechanisms 32L and 32R are positioned symmetrically around a line SL so that envelopes E are input to printer 10, similarly positioned symmetrically around center line CL.

Cassette 30 also includes an identification mark 34, which is recognizable by sensor 36 to indicate that cassette 30 is intended for input of pairs of envelopes. Preferably identification mark 34 comprises small magnets and sensor 36 comprises Hall effect switches, although any other suitable means of identifying cassettes may be used. Printer 10 is modified by programming controller 12 to respond to detection of identification mark 34 by sensor 36 to control laser scanner 16 to print addressing information on pairs of envelopes, as will be described further below.

While identification of cassettes for various types of input materials for use with printers and copiers and the like is known, and techniques for such recognition need not be discussed further here for an understanding of the subject invention.

Figure 2:
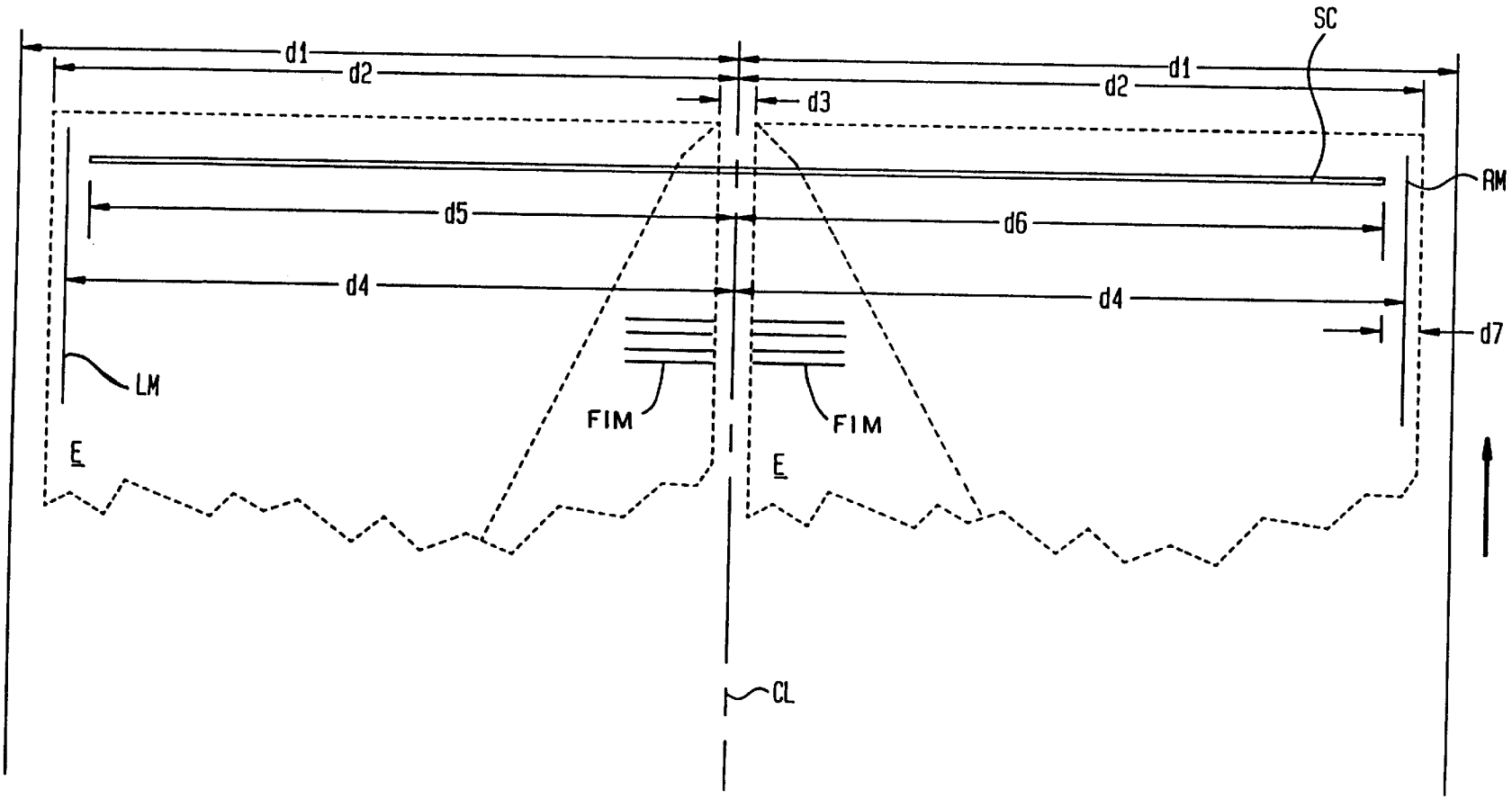
FIG. 2 is a schematic representation of the print geometry of the subject invention.

FIG. 2 shows a print geometry for a pair of envelopes feed through printer 10 in the most likely manner, positioned symmetrically around the system center line CL.

Values for dimensions for a typical laser printer intended to print $8^{1/2}$ size paper (i.e., the above mentioned W100) are given in Table 1.

Printer 10 provides for a maximum width d1 measured from center line CL. A pair of standard number 10 envelopes positioned symmetrically about center line CL will have their outer edges at a distance d2 when a clearance d3 is provided between the envelopes. Left margin LM and right margin RM are each a distance d4 from center line CL. A scan line SC is printed on the envelopes E at the point where drum 18 is in contact with envelopes E as they move through printer 10 in the direction shown. Typically, the left and right ends of line SC are at a distance d5 and d6 from center line CL, where distance d6 is normally made slightly greater than distance d5. Thus it can be seen in FIG. 2 that the FIM mark can be printed no closer to the outer edge of right envelopes E than a distance d7, which will normally be greater than the tolerances allowed by the Postal Service regulations.

In order to comply with U.S. Postal Service regulations without the need for offsetting of the envelopes and shifting of the printed image as is taught in the Czernik et al. reference, the envelopes are fed with their upper edges adjacent to center line CL and controller 12 is programmed so that when sensor 36 senses from identification mark 34 that envelope pairs are to be printed, controller 12 controls printer 10 to print an image comprising two fields registered with respect to center line CL so that each field is aligned with a corresponding envelope. Thus, a sub-image contained in each field is printed on a corresponding envelope. In order that the sub-images printed are properly oriented with respect to the envelopes, the sub-images are inverted with respect to each other. For example, if the geometry of printer 10 is such that single envelopes would be printed with their upper edge to the right, the sub-image to be printed on the left envelope (facing in the direction of motion) would be printed with the normal orientation and the sub-image to be printed on the right envelope would be inverted.

Other standards which have in the past been proposed, or may in the future be proposed, for printing address information may require that the envelopes be oriented with their lower edges adjacent to center line CL. To comply with such standards, the sub-images would be inverted and reversed with respect to their orientation when the upper edges are adjacent to center line CL. The orientation of the envelopes may be determined from identification mark 34 or may be input by an operator. Of course, when single items (or envelopes narrow enough to fall completely within the image) are to be printed, printer 10 can be controlled to print in a normal manner. Programming of controller 12 to form sub-images into composite images and to rotate and invert images is well-known in the art and need not be described further here for an understanding of the subject invention.

Figure 3:
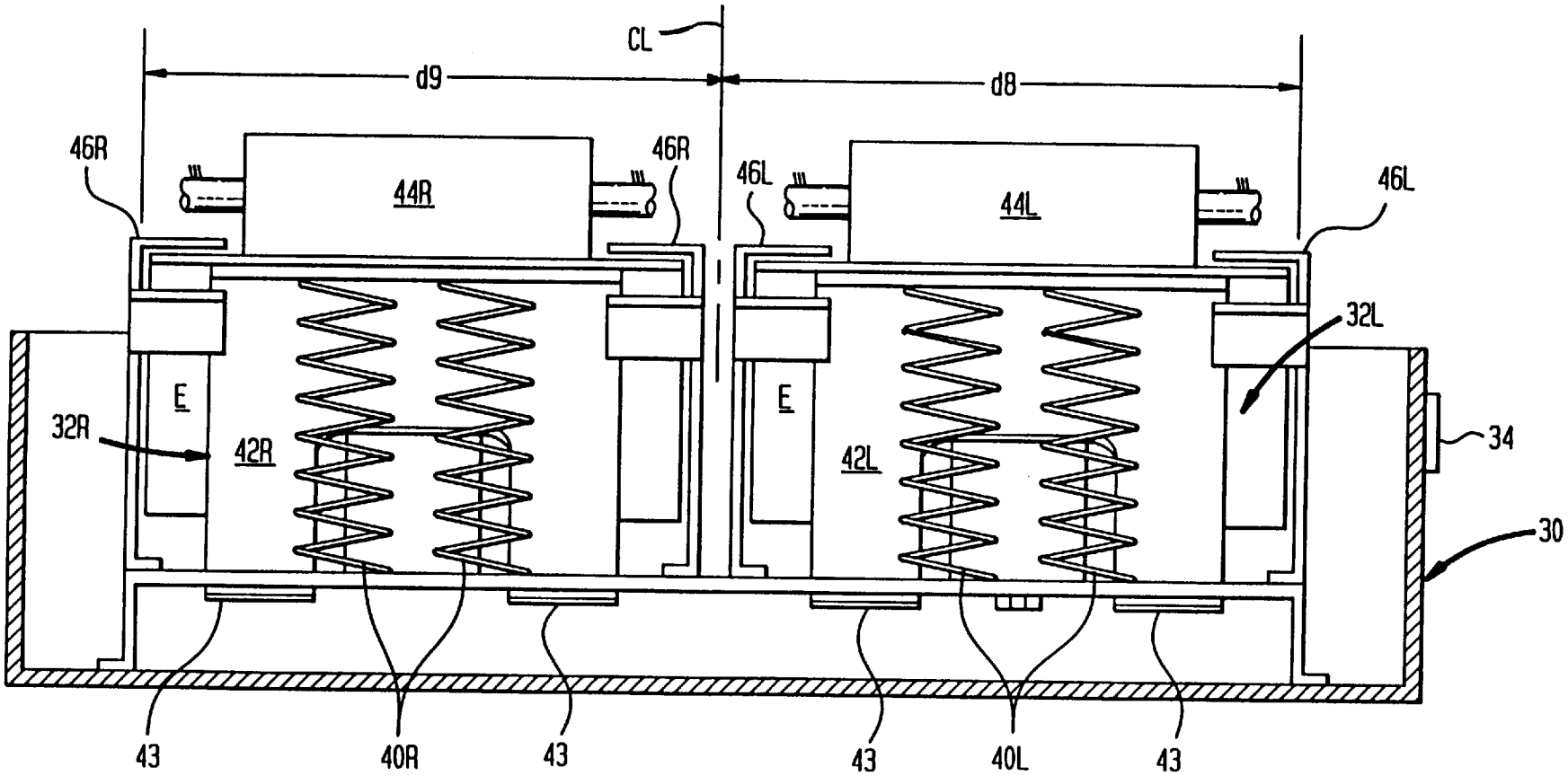
FIG. 3 is a cross sectional front view of a cassette for feeding pairs of envelopes simultaneously.

Turning to FIG. 3, a front cross sectional view of cassette 30 is shown. Cassette 30, as discussed above, includes mechanisms 32L and 32R for feeding stacks of envelopes E to printer 10. Preferably mechanisms 32L and 32R are conventional elevators substantially similar to those described in commonly assigned, co-pending U.S. application Ser. No. 07/492,035, Filed Mar. 12, 1990. Mechanisms 32L and 32R are positioned symmetrically around center line CL. Springs 40L and 40R apply a force against platforms 42L and 42R, causing platforms 42L and 42R to pivot about pivots 43 at the rear of the platforms and bringing rollers 44L and 44R into contact with envelopes E, which are the top-most envelopes of a stack supported by platforms 44L and 42R. Rollers 44L and 44R form part of printer 10 and operate under control of controller 12 to drive the top envelope E forward into printer 10. Conventional separator mechanisms (not shown) are provided in printer 10 to avoid double feeding of envelopes. In general, the operation of such cassettes is known and need not be discussed further here for an understanding of the subject invention and other suitable feeder mechanisms are also within the contemplation of the subject invention.

Mechanisms 32L and 32R also include guides 46L and 46R for establishing the lateral position of envelopes E as they are transported through printer 10. As can be seen in FIG. 4, guides 46L and 46R are positioned in accordance with the subject invention to establish dimensions d8 and d9 so that the envelopes are positioned in a predetermined manner, preferably symmetrically, around center line CL.

The above embodiments have been described by way of illustration only and numerous other embodiments of the subject invention will be apparent to those skilled in the art from consideration of the above description and the attached drawings. Accordingly, limitations on the subject invention are to be found only in the claims set forth below.

TABLE 1

| Dimension | Value (Millimeters) |
|---|---|
| d1 | 113 |
| d2 | 107 |
| d3 | 4.5 |
| d4 | 105 |
| d5 | 100.3 |
| d6 | 102.9 |
| d7 | 4.1 |
| d8 | 107 |
| d9 | 107 |
| d10 | 98.2 |
| d11 | 1.0 |

What is claimed is:

1. A system for printing two individual envelopes concurrently, comprising:

a) a printer which prints successive scan lines on a substrate as said substrate is transported through said printer;

b) a feeder for feeding pairs of individual envelopes concurrently along a feed path to said printer, whereby successive pairs of said individual envelopes form successive substrates for printing;

c) said feeder including an alignment guide for registering inboard edges of said individual envelopes with a center line of said feed path;

d) said printer further including a controller for controlling said printer to successively print images on said successive substrates, said images each comprising two fields, said fields being registered with said center line so that each of said fields is aligned with a corresponding one of said individual envelopes; whereby e) a sub-image contained in each of said fields is printed on said corresponding individual envelopes; and wherein f) said sub-images are inverted with respect to each other; and wherein g) said sub-images comprise FIM marks aligned with said inboard edges in accordance with a predetermined standard for printing said addressing information on said individual envelopes.

2. The system as described in claim 1 wherein said sub-images comprise addressing information for said corresponding individual envelopes.

3. The system as described in claim 1 wherein said inboard edges are upper edges of said individual envelopes.

4. The system as described in claim 1 wherein said inboard edges are lower edges of said individual envelopes and said sub-images are reversed and inverted with respect to their orientation when said inboard edges are upper edges.

5. A method for printing two individual envelopes concurrently, comprising the steps of:

a) positioning individual envelopes in a feeder;

b) concurrently feeding pairs of said individual envelopes along a feed path to a printer;

c) the inner edges of said pairs of individual envelopes being registered with respect to a center line of said feed path;

d) controlling said printer to successively print images on successive pairs of said individual envelopes, said images comprising two fields, said fields being registered with respect to said center line so that each of said fields is aligned with a corresponding one of said individual envelopes;

whereby e) a sub-image contained in each of said fields is printed on said corresponding item; and wherein f) said sub-images are inverted with respect to each other, and wherein g) wherein said sub-images comprise FIM marks aligned with said inboard edges in accordance with a predetermined standard for printing said addressing information on said envelopes.

6. The method as described in claim 5 wherein said sub-images comprise addressing information for said corresponding individual envelopes.

7. The method as described in claim 5 wherein said inboard edges are upper edges of said individual envelopes.

8. The system as described in claim 5 wherein said inboard edges are lower edges of said individual envelopes and said sub-images are reversed and inverted with respect to their orientation when said inboard edges are upper edges.

* * * * *